US007753345B2

(12) United States Patent
Arzberger et al.

(10) Patent No.: US 7,753,345 B2
(45) Date of Patent: Jul. 13, 2010

(54) WINCH

(75) Inventors: Maximilian Arzberger, Igenhausen (DE); Christian Herrmann, Altomünster (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 12/292,344

(22) Filed: Nov. 17, 2008

(65) Prior Publication Data

US 2009/0134373 A1 May 28, 2009

(30) Foreign Application Priority Data

Nov. 28, 2007 (EP) ..... 07023066

(51) Int. Cl.
*B66D 1/00* (2006.01)

(52) U.S. Cl. ..... 254/332; 254/329

(58) Field of Classification Search ..... 254/329, 254/331, 332

See application file for complete search history.

(56) References Cited

U.S. PATENT DOCUMENTS

| | | | | |
|---|---|---|---|---|
| 2,262,325 | A * | 11/1941 | Kendall | 198/806 |
| 3,690,409 | A | 9/1972 | Brauss | |
| 4,002,321 | A | 1/1977 | Shaw et al. | |
| 4,050,587 | A * | 9/1977 | Moen | 212/301 |
| 4,490,936 | A * | 1/1985 | Svendsen | 43/8 |
| 5,246,181 | A * | 9/1993 | Straub et al. | 242/399.2 |
| 6,053,478 | A * | 4/2000 | Friedman | 254/332 |
| 6,523,806 | B2 * | 2/2003 | Bartal | 254/323 |
| 7,080,826 | B2 * | 7/2006 | Pockl et al. | 254/332 |

FOREIGN PATENT DOCUMENTS

| | | |
|---|---|---|
| DE | 103 43 079 B3 | 5/2005 |
| FR | 2 278 619 A | 2/1976 |
| GB | 882 874 | 11/1961 |
| GB | 1 249 405 | 10/1971 |
| GB | 2 132 971 A | 7/1984 |
| GB | 2 296 001 A | 6/1996 |
| WO | WO 96/18566 | 6/1996 |
| WO | WO 03/053821 | 7/2003 |

* cited by examiner

*Primary Examiner*—Emmanuel M Marcelo
(74) *Attorney, Agent, or Firm*—Jacobson Holman PLLC

(57) ABSTRACT

The invention relates to a winch comprising a drum, a rotary drum bearing, on which the drum is supported in a rotating manner, a supporting device, on which the rotary drum bearing is supported in a pivotable manner by means of at least one pivot joint, and an actuating drive for the active pivoting of the drum. The pivot axis extends inside the drum and the actuating drive is arranged at least partially inside the drum.

13 Claims, 4 Drawing Sheets

WINCH

The invention relates to a winch comprising a drum, a rotary drum bearing, on which the drum is supported in a rotating manner about an axis of rotation, a supporting device, on which the rotary drum bearing is supported in a pivotable manner together with the drum by means of at least one pivot joint about a pivot axis, and an actuating drive for the active pivoting of the drum about the pivot axis.

From the prior art construction machines with a variety of different drum winches are known. In the case of soil working tools, such as for instance an auger, a trench wall cutter, a soil-mixing rod or a drill rod, these are guided on a mast and are carried by a hoisting rope. A winch is provided for driving the hoisting rope.

Furthermore, winches can be employed for supply hoses, hydraulic hoses or electrical cables. Especially in the case of supply hoses with a relatively large hose diameter a neat hose winding is of great importance with regard to wear and tear.

To achieve a long service life a neat winding onto the drum is of utmost significance. For this purpose it is known to pivot the drum in order to adjust a desired run-in angle of the hose or rope. The run-in position is also important for a neat winding onto the drum which in turn has an influence on the wear and tear.

A generic winch is known from DE 103 43 079 B3. This printed publication describes a winch for operating a hoisting rope to carry a soil working tool for a construction machine comprising a drum, a winch frame, in which the drum is supported in a rotating manner about an axis of rotation, a winch support, with respect to which the winch frame with the drum is supported in a pivotable manner through a pivot joint about a pivot axis. Furthermore, an actuating drive is provided for the active pivoting of the drum about the pivot axis.

WO 03/053821 A2 describes a winch assembly having a drum that can be pivoted about a pivot axis. Thereby the pivot axis intersects the drum axis so that when the drum is pivoted the drum axis performs a tumbling movement about the pivot axis. For the active pivoting of the drum hydraulic cylinders are provided.

GB 2 296 001 A, U.S. Pat. No. 4,002,321, FR 2 278 619 A and GB 21 32 971 A disclose further winch devices, which each have a drum that can be pivoted about a pivot axis. In these cases hydraulic actuators are provided for the active pivoting of the drum.

Likewise, GB 882 874 and GB 1249 405 relate to winch devices with pivotable drums, and here the pivoting is brought about by way of the rope force. To this end additional elements for damping and/or limiting the pivoting movement are provided.

The object of the invention is to provide a winch having an actively pivotable drum, which is arranged in a compact and space-saving manner and operates reliably.

The invention solves the object by a winch having: a drum, rum bearing, on which the drum is supported in a rotating manner about an axis of rotation, a supporting device, on which the rotary drum bearing is supported in a pivotable manner together with the drum by means of at least one pivot joint about a pivot axis, and an actuating drive for the active pivoting of the drum about the pivot axis, wherein the pivot axis extends inside the drum and the actuating drive is arranged at least partially inside the drum.

The winch according to the invention is characterized among other things in that the pivot axis extends inside the drum and the actuating drive is arranged at least partially inside the drum.

A fundamental idea of the invention resides in the fact that the interior space of the drum is utilized to accommodate various elements, in particular the actuating drive. This leads to an especially compact and space-saving arrangement of the winch. Moreover, the elements arranged in the interior space of the drum are especially protected against external interference, such as mechanical effects or weather-related influences, and are therefore exposed to a smaller degree of wear. As a result, the service life of the sensitive actuating drive is increased in particular so that maintenance and repair costs for failures caused by wear can be reduced. In addition, the reliable operation of the winch rendered possible in this way also permits a longer, continued use without any time-consuming or cost-intensive downtimes.

Owing to the compact and robust arrangement of the winch it can also be used efficiently where space is confined. In particular, it is advisable to arrange the winch on a mobile carrier with limited dimensions.

The winch according to the invention proves to be particularly advantageous for hoses but it is also suitable for all kinds of ropes and electrical or data cables. For the sake of simplicity the element that is to be wound up shall be referred to in the following as a hose, without the invention being limited thereto.

The pivotable support of the drum about a pivot axis allows a substantial optimization for the run-in angle of the hose onto the drum. For best suitability, the run-in angle can be chosen or changed in such a manner that a particularly reliable, exact winding-up is ensured in the case of a single-layer or multi-layer winding whilst assuring an especially minimal degree of wear at the same time.

The actuating drive can be realized in different ways. It is especially advantageous if the actuating drive has a hydraulic element, more particularly a hydraulic cylinder. With an element of such kind relatively high forces can be exerted on a minimum of space. As a result, even extremely heavy and fully loaded drums can still be moved in a reliable manner. Moreover, hydraulic cylinders distinguish themselves by a very service-friendly and reliable mode of operation. Alternatively, the actuating drive can also be operated pneumatically or by means of an electric linear drive, as for example a toothed rack.

Advantageously, the actuating drive is articulated on the one hand to the rotary drum bearing and on the other hand to the supporting device. The actuating drive can be articulated for example to a hub disk of the rotary drum bearing. In this way a pivot axis that extends inside the drum can be realized in an especially easy manner. There likewise, the actuating drive can also be arranged in a suitable manner inside the drum. What is more, the distances that have to be covered by the actuating-drive in order to pivot the drum are thereby reduced. Consequently, the energy consumption and possible wear effects are diminished.

Basically, the angle between the pivot axis and the axis of rotation can be an acute angle or obtuse angle. It is of advantage if the pivot axis is directed transversely to the axis of rotation. However, for best suitability the angle between the pivot axis and the axis of rotation amounts to approximately 90°. This permits a symmetrical construction of the drum bearing, which is particularly suitable for absorbing tensile forces that may occur during the operation of a construction machine. By preference, the pivot axis extends approximately perpendicularly to a run-in plane of the hose, in which the hose moves especially during winding-up on and/or unwinding from the drum. In such an arrangement the run-in angle can be optimized in the case of particularly small pivot angles of the drum about the pivot axis.

The winch according to the invention distinguishes itself among other things by the fact that the pivot axis extends inside the drum. Such an arrangement can be implemented in a very compact and space-saving way. Here the rotary drum bearing with the drum is supported by means of a pivot joint on a supporting device. Such a pivot joint can serve to absorb a considerable part of the tensile forces of the winch, whereby a pivoting of the drum about the pivot axis is rendered possible with a particularly low expenditure of force. By preference, two pivot joints are provided along the pivot axis in order to support the rotary drum bearing on the supporting device.

In accordance with the invention the actuating drive is arranged at least partially inside the drum. An arrangement of such kind permits an especially compact construction of the winch whilst offering particular protection of the sensitive actuating drive against external mechanical influences.

Furthermore, according to the invention it is useful that a pivot measuring device is provided for measuring a pivoting, in particular a pivot angle of the drum with respect to the supporting device. The pivot measuring device suitably includes a value-setting indicator and/or an incremental indicator.

The actuating drive provided in accordance with the invention for the active pivoting of the drum into the pivot axis ensures an especially reliable winding-up and/or unwinding with a low wearing.

Basically, the actuating drive can have e.g. a gear unit, which converts an inclination of the mast in a mechanical way into a pivot angle. However, it is particularly suitable for the actuating drive to have at least one hydraulic cylinder, which can be articulated on the one hand to a hub disk of the rotary drum bearing and on the other hand to the supporting device. In this way an especially reliable and low-maintenance actuating drive is made available. The actuating drive preferably has two hydraulic cylinders, which are articulated diametrically opposite each other to the hub disk of the rotary drum bearing and the supporting device, respectively. Such a diametrical arrangement in particular of counter-acting hydraulic cylinders permits an especially reliable and safe pivoting of the drum in the case of high tensile forces.

A particularly useful embodiment of a winch in accordance with the invention is characterized in that a length-measuring device is provided for measuring a hose length wound onto and/or unwound from the drum. If the dimensions of the winch and/or the hose are known, conclusions can be drawn from such a length measurement as to the position of a winding to be carried out, i.e. a run-in point, with respect to a longitudinal axis of the drum. This in turn renders it possible to determine the current optimal pivot angle and the drum can be pivoted accordingly by means of the actuating drive. Hence, a particularly low-wear winding can be achieved even in the case of especially wide drums.

Finally, according to a further development of the invention an especially precise pivoting of the drum is rendered possible in that a control device is provided for controlling the actuating drive, which is connected in particular to the pivot measuring device. For an especially effective optimization of the run-in angle the pivot measuring device can be connected alternatively or additionally also to the length measuring device.

Advantageously, the winch according to the invention is a free-wheeling winch or a free-fall winch with residual tackle and/or drag-rope mechanism.

It is of advantage if the supporting device has a C-shaped cross-section with two retaining arms, on which the rotary drum bearing is retained by a respective pivot bolt. With this arrangement a highly stable construction of the winch can be realized with only a minimum of material required. In the open part of the supporting device the hose can be led out in a very easy way. The two retaining arms, which are each articulated by means of a pivot bolt to the hub disk of the rotary drum bearing, ensure a uniform distribution of the mechanical stresses onto the entire hub disk surface. As a result, conditions of stress that may lead to defects are reduced. The arrangement of the two pivot bolts for the purpose of forming the pivot joints as well as an articulation to the hub disk on the one hand and to the supporting device on the other hand render it possible for the pivot axis to extend inside the drum, whereby the sensitive pivot joints are largely protected against external influences and their reliability is increased.

By preference, a hose or cable connection is provided which extends at least partially in a substantial manner within the axis of rotation of the drum. Hoses for feeding fluid media, such as suspensions, or for the supply of hydraulic or cooling fluid can be connected to such a connection. The connection of cables for the transmission of information or for the supply of electricity is possible, too. A so-called rotary feed-through provides a reliable connection between the stationary and the rotating part.

Due to the axial arrangement with respect to the axis of rotation of the drum, even a further rotation of the drum does not lead to a twisting of the connected hose or cable. Moreover, a connection at this position is particularly easily accessible for a mechanic and thereby facilitates the connection of corresponding lines or devices.

With regard to the construction machine the invention is characterized in that a winch in accordance with the invention is provided.

It is especially advantageous for the winch to be provided for operating a rope to carry a soil working tool or to carry a hose or cable in order to convey material or for the hydraulic or electrical supply respectively.

A further development of a construction machine according to the invention resides in the fact that an inclination device is provided, with which the mast can be inclined laterally with respect to a base body, in particular with respect to a running direction of the hose and/or an axis extending through the mast and the base body. Such an inclination device makes it possible to incline the mast with respect to the base body with a lateral inclination angle of up to 10°, preferably up to 5°, and to produce boreholes and perhaps piles with a corresponding inclination with respect to the horizontal.

In accordance with the invention it is furthermore preferred that an inclination measuring device for measuring a lateral inclination of the mast with respect to the base body is provided, which is connected to a control device of an actuating drive of the winch, in which case the actuating drive can serve for the inventive pivoting of the drum. In this manner a lateral inclination angle-dependent pivoting of the drum about a pivot axis is rendered possible in such a way that a bending stress of the rope during running into the drum is reduced to a large degree.

To provide especially high tensile forces, it is preferred according to the invention that the winch is arranged on the base body. For best suitability the winch is arranged on a part of the base body that cannot be inclined with respect to the base body by the inclination device.

In the following the invention is described further by way of a preferred embodiment, which is shown schematically in the drawings, wherein.

Figure 1:
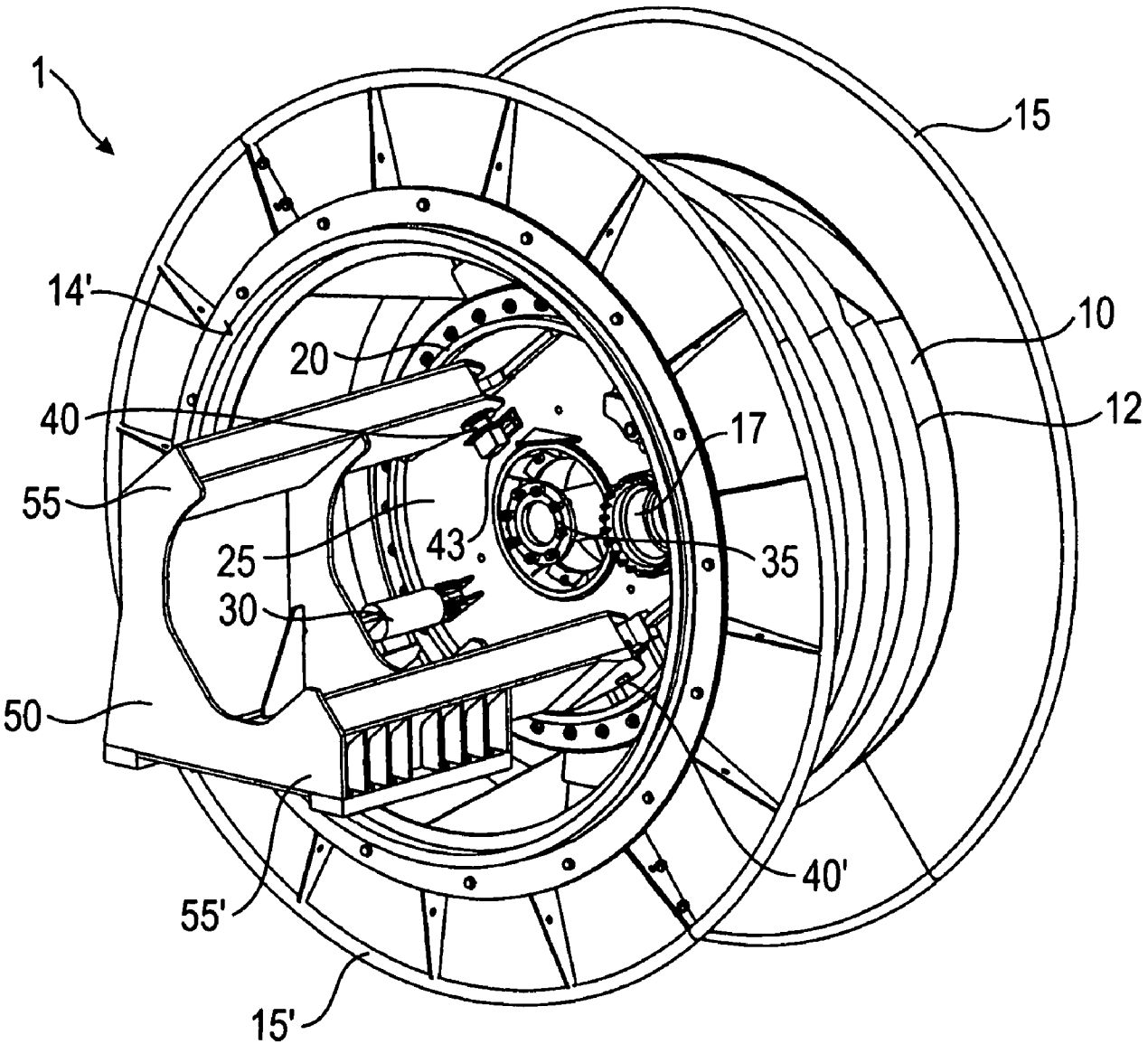
FIG. 1 shows an oblique front view of a winch according to the invention.

FIGS. 1 to 4 show a winch 1 according to the invention. The winch 1 has a cylindrical drum 10 for receiving a hose or the like. On the surface of the drum 10 a profile 12 in the shape of a protruding corrugation is provided for defined guidance and winding of the hose (not illustrated). Close to the front faces 14, 14' of the drum 10 circular coil walls 15, 15' are formed on the drum 10 for laterally limiting the windings of the hose. The drum 10 can be driven in a rotating manner by means of a drive motor, which is not shown here and is flanged on an eccentric base 17, about an axis of rotation 13, wherein the said axis of rotation 13 coincides with the longitudinal axis of the cylindrical drum 10.

Figure 2:
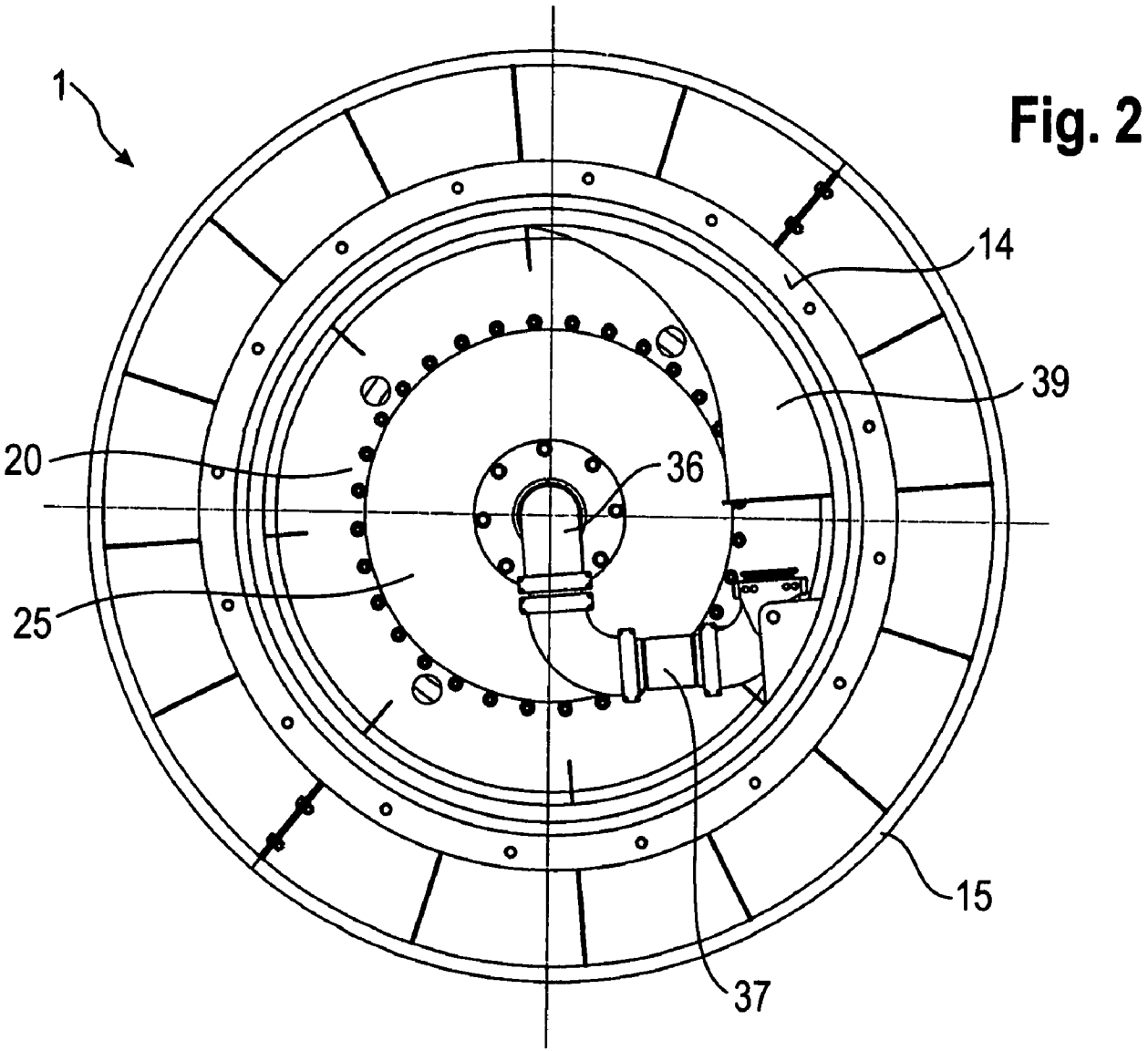
FIG. 2 shows a rear view of the winch of FIG. 1.

Via a drum run-out part 39 shown in FIG. 2 the hose exits laterally from the drum 10 and enters into a connecting line 37. The connecting line 37 leads to a rotary feed-through 36 on the axis of rotation 13 of the drum 10. The rotary feed-through 36 which rotates jointly with the drum 10 forms a direct transition to a fixed connection 35, by which the hose can be connected to external devices such as a pump. By means of a rotary drum bearing 20 the drum 10 is supported in a rotating manner on a hub disk 25. On the hub disk 25 a supporting device 50 formed as a fork with a C-shaped cross-section and with two retaining arms 55, 55' is attached by two pivot joints 40, 40'. The pivot joints 40, 40' are each formed as hinges with pivot bolts on the retaining arms 55, 55'. The supporting device 50 is articulated in a pivotable manner by the pivot joints 40, 40' to the hub disk 25. The pivot axis 43 is formed by the connecting line between the pivot joints 40, 40' and is located perpendicularly on the axis of rotation 13 of the drum 10. Both, the pivot joints 40, 40' and the pivot axis 43 are located inside the drum 10. Furthermore, between the supporting device 50 and the hub disk 25 an actuating drive 30 is provided that is designed as a hydraulic cylinder. The piston rod of the hydraulic cylinder is articulated to the supporting device 50 and to the hub disk 25.

Figure 3:
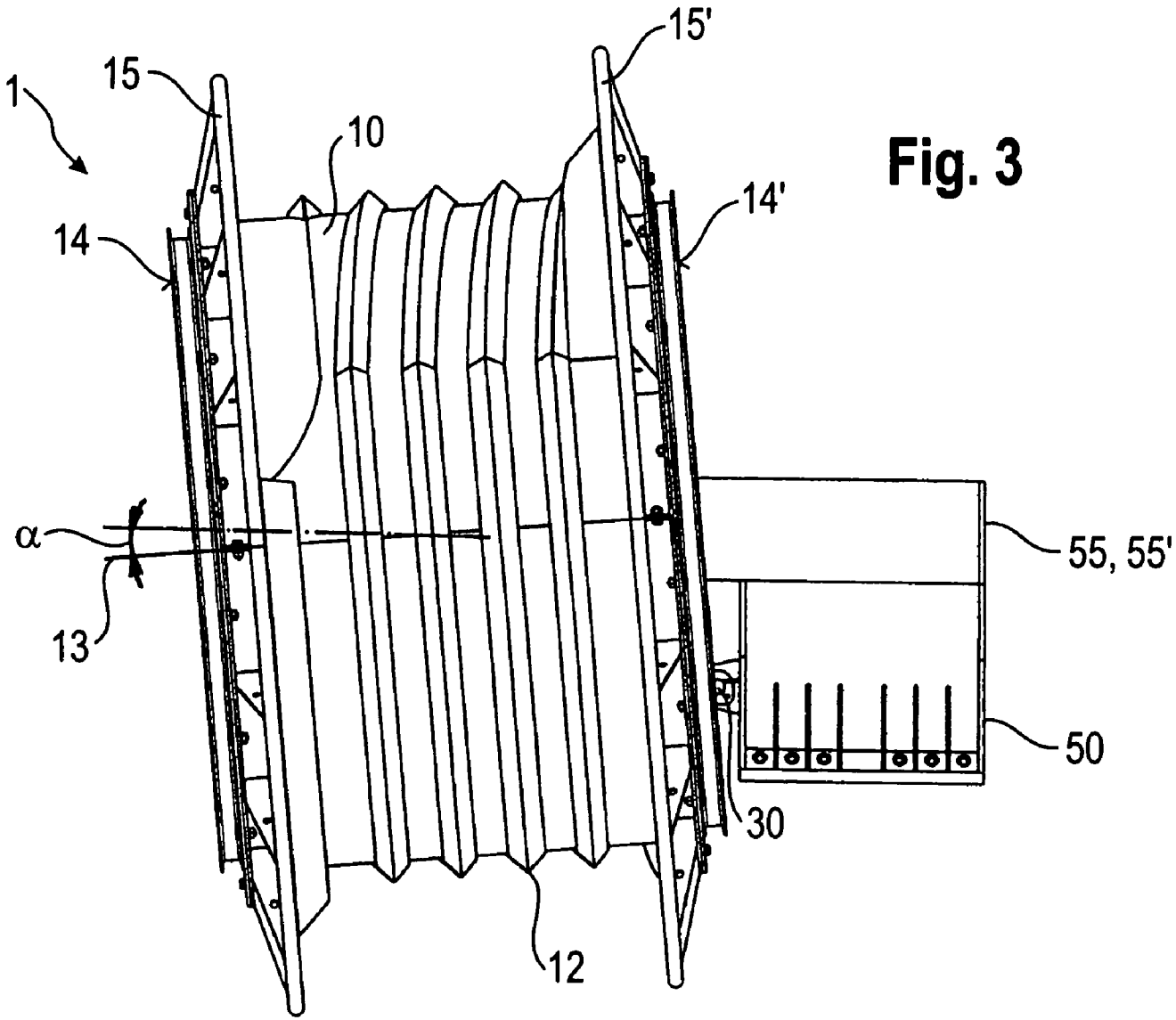
FIG. 3 shows a plan view of the winch according to the invention in the pivoted state.
Figure 4:
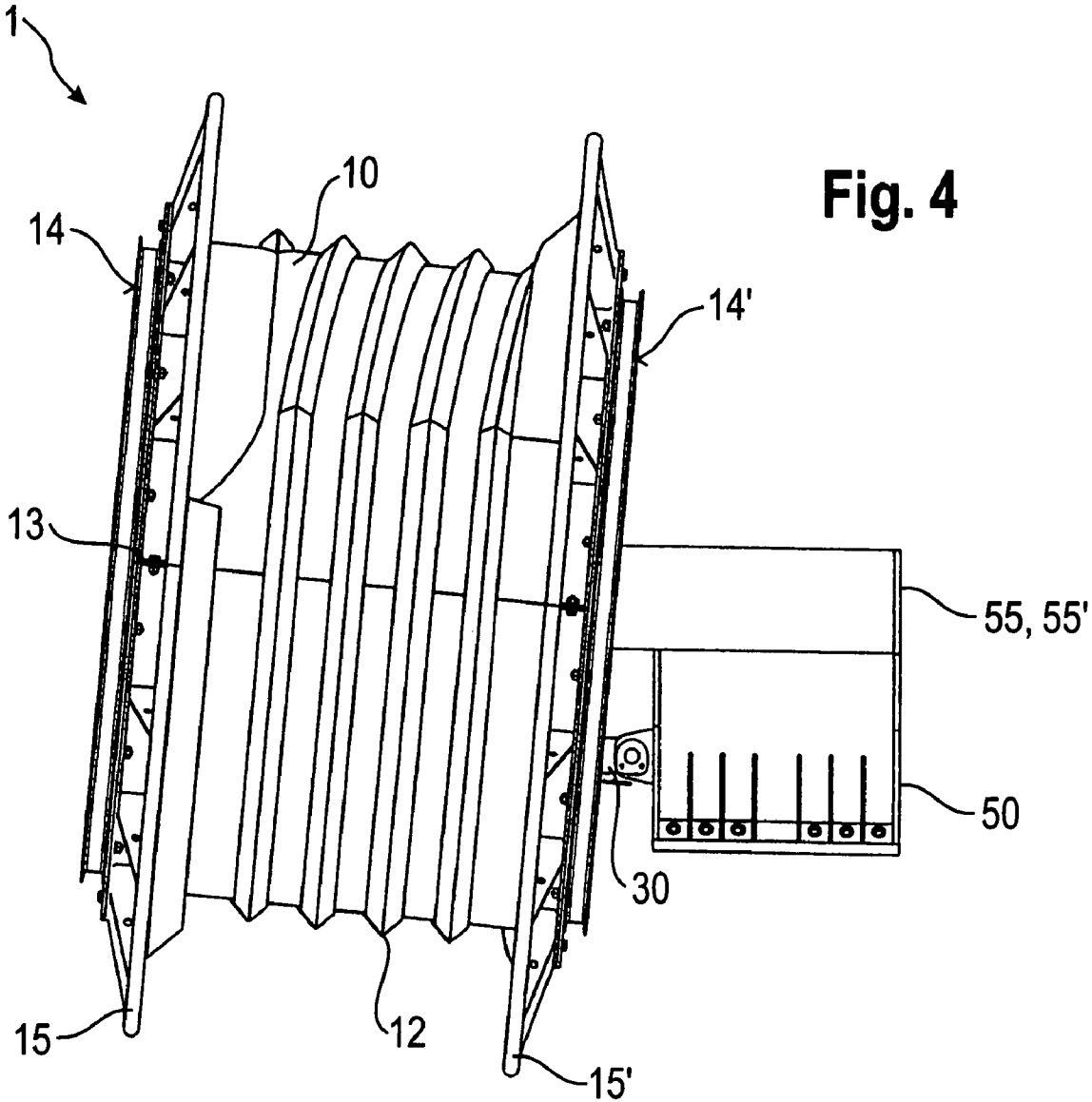
FIG. 4 shows a plan view of the winch according to the invention in the non-pivoted state.

In the state of the winch 1 shown in FIG. 3 the piston rod of the hydraulic cylinder is inserted about an insertion path as compared to the non-pivoted state of the drum 10, so that the axis of rotation 13 of the drum 10 is pivoted with respect to the supporting device 50 by the pivot angle $\alpha$ about the pivot axis 43. In the state of the winch 1 shown in FIG. 4 the piston rod of the hydraulic cylinder is extended from the piston housing and the drum 10 is in a non-pivoted state with respect to the supporting device 50.

The invention claimed is:

1. Winch comprising a drum, a rotary drum bearing, on which the drum is supported in a rotating manner about an axis of rotation, a supporting device, on which the rotary drum bearing is supported in a pivotable manner together with the drum by means of at least one pivot joint about a pivot axis, and an actuating drive for the active pivoting of the drum about the pivot axis, wherein the pivot axis extends inside the drum and in that the actuating drive is arranged at least partially inside the drum.

2. Winch according to claim 1, wherein the actuating drive has at least one hydraulic cylinder.

3. Winch according to claim 2, wherein the hydraulic cylinder is articulated on the one hand to a hub disk of the rotary drum bearing and on the other hand to the supporting device.

4. Winch according to claim 1, wherein the pivot axis is directed transversely to the axis of rotation.

5. Winch according to claim 1, wherein a pivot measuring device is provided for measuring a pivot angle of the drum with respect to the supporting device.

6. Winch according to claim 5, wherein the supporting device has a set value transmitter.

7. Winch according to claim 1, wherein a length-measuring device is provided for measuring a hose length wound onto or unwound from the drum.

8. Winch according to claim 1, wherein a control device is provided for controlling the actuating drive, which is connected in particular to a pivot measuring device or a length measuring device.

9. Winch according to claim 1, wherein the supporting device has a C-shaped cross-section with two retaining arms, on which the rotary drum bearing is retained by a respective pivot bolt.

10. Winch according to claim 1, wherein a hose or cable connection is provided, which extends within the axis of rotation of the drum.

11. Winch according to claim 1, wherein the angle between the pivot axis and the axis of rotation amounts to approximately 90°.

12. Winch according to claim 1, wherein the pivot axis extends approximately perpendicularly to a run-in plane of a hose.

13. Construction machine, for foundation construction, the construction machine comprising a drum, a rotary drum bearing, on which the drum is supported in a rotating manner about an axis of rotation, a supporting device, on which the rotary drum bearing is supported in a pivotable manner together with the drum by means of at least one pivot joint about a pivot axis, and an actuating drive for the active pivoting of the drum about the pivot axis, wherein the pivot axis extends inside the drum and in that the actuating drive is arranged at least partially inside the drum.

* * * * *